US006216693B1

(12) United States Patent
Rekow et al.

(10) Patent No.: US 6,216,693 B1
(45) Date of Patent: Apr. 17, 2001

(54) RESPIRATOR HAVING A COMPRESSIBLE PRESS FIR FILTER ELEMENT

(75) Inventors: Peter O. Rekow, Woodbury; Thomas W. Holmquist-Brown, St. Paul; David L. Braun, Lake Elmo; Vaughn B. Grannis, Inver Grove Heights, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 08/376,199

(22) Filed: Jan. 20, 1995

(51) Int. Cl.[7] ..... A62B 23/02; A62B 7/10

(52) U.S. Cl. ..... 128/205.27; 128/206.17

(58) Field of Search ..... 128/206.17, 205.27; 264/324, 230, 342 R, DIG. 71

(56) References Cited

U.S. PATENT DOCUMENTS

| | | | | |
|---|---|---|---|---|
| 1,499,864 | * | 7/1924 | Gordon | 55/DIG. 35 |
| 3,118,445 | | 1/1964 | Norman | 128/141 |
| 3,381,070 | * | 4/1968 | Subleh et al. | 264/122 |
| 3,544,507 | | 12/1970 | Lloyd . | |
| 4,061,807 | | 12/1977 | Shaler et al. | 428/36 |
| 4,064,876 | | 12/1977 | Mulchi | 128/146.6 |
| 4,141,703 | | 2/1979 | Mulchi | 55/316 |
| 4,304,230 | * | 12/1981 | Seufert | 128/206.17 |
| 4,422,861 | | 12/1983 | Dusza | 55/498 |
| 4,548,626 | | 10/1985 | Ackley et al. | 55/316 |
| 4,562,837 | | 1/1986 | Schlobohm | 128/206.17 |
| 4,630,604 | | 12/1986 | Montesi | 128/206.15 |
| 4,636,232 | | 1/1987 | McDowell | 55/350 |
| 4,664,683 | | 5/1987 | Degen et al. | 55/387 |
| 4,665,050 | | 5/1987 | Degen et al. | 502/402 |
| 4,688,567 | * | 8/1987 | Kikuchi et al. | 128/206.15 |
| 4,767,426 | * | 8/1988 | Daly et al. | 210/315 |
| 4,771,771 | | 9/1988 | Walther | 128/201.25 |
| 4,790,306 | | 12/1988 | Braun et al. | 128/206.12 |
| 4,832,018 | | 5/1989 | Pantaleon-Stemberg | 128/206.17 |
| 4,850,346 | | 7/1989 | Michel et al. | 128/206.15 |
| 4,856,508 | | 8/1989 | Tayebi | 128/206.12 |
| 4,865,637 | | 9/1989 | Gruber | 55/502 |
| 4,886,058 | | 12/1989 | Brostrom et al. | 128/206.12 |
| 4,945,907 | | 8/1990 | Tayebi | 128/206.12 |
| 4,964,900 | | 10/1990 | Thompson et al. | 55/387 |
| 4,976,857 | * | 12/1990 | Solomon | 264/230 |
| 5,022,394 | | 6/1991 | Chmielinski | 128/207.14 |
| 5,022,901 | | 6/1991 | Meunier | 55/316 |
| 5,033,465 | | 7/1991 | Braun et al. | 128/205.27 |
| 5,036,844 | | 8/1991 | Pouchot et al. | 128/206.17 |
| 5,062,421 | | 11/1991 | Burns et al. | 128/205.27 |

(List continued on next page.)

FOREIGN PATENT DOCUMENTS

| | | | |
|---|---|---|---|
| 2 160 049 | 6/1973 | (DE) | A62B/23/02 |
| 0 124 263 A2 | 11/1984 | (EP) | A62B/18/02 |
| 159 696 A2 | 10/1985 | (EP) | B01J/20/20 |
| 159 698 A2 | 10/1985 | (EP) | B01D/53/04 |
| 0 242 703 A2 | 10/1987 | (EP) | A62B/21/00 |
| 384 716 A2 | 8/1990 | (EP) | B29C/67/16 |
| 450369 | 7/1936 | (GB) . | |
| 823887 | 11/1959 | (GB) . | |
| 62-106778 | 5/1987 | (JP) . | |

OTHER PUBLICATIONS

Sundstrom product literature, *Instructions For Using SR–62/80 Facemask and 235–4 Compressed Air Attachment.*

*Primary Examiner*—John G. Weiss
*Assistant Examiner*—Joseph F. Weiss, Jr.
(74) *Attorney, Agent, or Firm*—Karl G. Hanson

(57) ABSTRACT

A respirator 10 includes a compressible filter element 12, a filter element retainer 14, and a face piece 16. The respirator is unique in that the filter element 12 compresses when installed in the retainer 14, allowing a friction fit to be maintained between the filter element 12 and retainer 14. The friction fit enables the filter element 12 to be readily replaced when its service life has expired.

27 Claims, 3 Drawing Sheets

U.S. PATENT DOCUMENTS

| | | | | |
|---|---|---|---|---|
| 5,063,926 | | 11/1991 | Forsgren et al. | 128/206.17 |
| 5,078,132 | | 1/1992 | Braun et al. | 128/206.12 |
| 5,148,803 | | 9/1992 | Schlobohm | 128/205.27 |
| 5,222,488 | * | 6/1993 | Forsgren | 128/201.25 |
| 5,240,479 | | 8/1993 | Bachinski | 55/103 |
| 5,290,502 | * | 3/1994 | Jeffrey et al. | 264/324 |
| 5,353,789 | | 10/1994 | Schlobohm | 128/206.24 |
| 5,390,668 | * | 2/1995 | Lehman | 128/205.27 |

* cited by examiner

RESPIRATOR HAVING A COMPRESSIBLE PRESS FIR FILTER ELEMENT

TECHNICAL FIELD

This invention pertains to a respirator that has a compressible press fit filter element.

BACKGROUND OF THE INVENTION

In the respirator art, many techniques have been used to attach filter elements to respirators. A common technique uses threads to attach the filter element to a corresponding threaded fitting on the body of the respirator; see, for example, U.S. Pat. Nos. 5,222,488, 5,063,926, 5,036,844, 5,022,901, 4,548,626, and 4,422,861. The filter elements typically possess helical or advancing spiral threads that mate with a tapped collar or socket that receives the filter element's threaded portion. Rotating the filter element in the appropriate direction allows the filter element to be attached to or removed from the respirator.

In another technique disclosed in U.S. Pat. No. 5,148,803, a bellows is used to fasten a filter element to a respirator. The bellows, together with a rigid band, form a rigid cuff that receives the filter element. The cuff is continued in an elastic sleeve, which surrounds the filter element in a gas-tight manner. To change the filter element, the sleeve is first folded back to the level of the cuff, allowing the filter element to be removed. During assembly, the filter element is inserted into the cuff, and the sleeve is then folded back over the filter element.

U.S. Pat. Nos. 5,078,132 and 5,033,465 disclose a respirator that uses edge seals to secure a filter element to an elastomeric face piece of the respirator. The filter element includes bonded activated carbon granules, and the edge seals are disposed between the filter element and the elastomeric face piece and are made of a suitable adhesive material such as a hot-melt adhesive, a hot-melt foam adhesive, or a latex adhesive.

A foam mask shell used in U.S. Pat. No. 4,856,508 for placing a filter element in a respirator. The foam mask shell possesses a collar that defines an opening for receiving the filter element. The filter element has an extension with an outside dimension approximately equal to the inside dimension of the cylindrical passage through the collar. To mount the filter element, its extension is inserted into the opening where it makes a relatively tight friction fit. When the extension is inserted into the opening, the latter expands due to flexibility of the foam material in the mask shell. To replace a filter element, it is grasped and twisted back and forth while pulling it away from the mask shell.

Insert molding is used in U.S. Pat. No. 4,790,306 to permanently secure a bonded absorbent filter element to a respirator face piece.

A plug-in frame is described in U.S. Pat. No. 4,771,771 to secure a filter cartridge in a chamber of the respirator. The filter cartridge is disposed in the chamber by seals that bear tightly against the cartridge to hold it in place. The filter cartridge can be fitted to the respirator by sliding it through an opening in the plug-in frame.

In U.S. Pat. No. 4,630,604 locking tongues are employed on a filter retainer to hold a replaceable filter element in an abutting relationship to the respirator frame. The filter member can be replaced by snapping off the filter retaining member from the frame.

A further technique is disclosed in U.S. Pat. No. 4,562,837, where the respirator is provided with a guide ring for engaging a filter housing. The guide ring is carried by a sleeve portion that defines an opening through which the gasses pass. The filter housing is slidable on the guide ring from a retracted stand-by position to an extended use position. A bellows located between the filter element and the respirator, permits movement of the filter element between its retracted stand-by position and its extended use position.

Sundström Safety AB of Lidingö, Sweden markets a respirator under the designation SR-62, which uses an elastomeric rubber filter retainer for accommodating a filter element. The filter element comprises a gas and vapor or particulate filter in a rigid injection molded plastic cartridge. To insert the filter element into the retainer, the retainer is stretched over the periphery of the filter element.

Although the above-discussed respirators use various techniques for securing a filter element to a respirator, these techniques have a number of drawbacks. For example, the filter elements that are threaded to the respirator typically include a housing or canister into which the filter material is retained. The cartridge's cylindrical geometry typically requires using the filter element as an appendage or external cartridge on the respirator which can interfere with a wearer's vision. Further, the threaded cartridges employ many parts which can add to the total volume of the filter element and overall weight of the respirator. In other types of designs, such as disclosed in U.S. Pat. Nos. 5,078,132, 5,033,465, and 4,790,306, the filter elements are not able to be readily replaced, and thus when the service life of the filter element has met its limit, the whole respirator is discarded as waste. In the model SR-62 respirator sold by Sundström, the filter element is replaceable; however, the retainer lacks physical strength relative to the filter element, and thus, like placing a rubber tire on a wheel, a number of manual manipulations are needed to place the filter element in the elastomeric rubber retainer. In addition, elastomeric materials can be relatively expensive and more difficult to process. Many of the other respirators discussed above possess the drawback of using fairly complicated systems for mounting the filter element to the respirator.

SUMMARY OF THE INVENTION

The respirator of this invention overcomes many of the drawbacks of prior art respirators. The respirator does not employ many parts to secure the filter element to the respirator face piece. The filter element is replaceable and lightweight, and it can be mounted to the retainer in a single motion without excessive manipulation. In addition, the respirator of the invention allows a filter element to attain a firm air-tight seal to the face piece without use of a permanent adhesive. In brief summary, the respirator of the invention comprises: (a) a face piece sized to fit over the nose and mouth of a person; (b) a compressible filter element having first and second faces separated by a peripheral surface; and (c) a filter element retainer connected to the face piece, the filter element retainer receiving the compressible filter element and including a wall that frictionally engages the peripheral surface of the filter element to provide a hermetic seal thereto and to allow the filter element to be removed from the retainer by a manual force.

The respirator of this invention differs from known respirators by its use of a compressible filter element that frictionally engages a filter element retainer The compressible filter element in combination with its frictional engagement to the retainer allows the filter element to be readily removed from a respirator and replaced with minimal effort and requires a minimal number of parts to mount the former to the latter. The invention also can avoid the use of elastomeric rubbers which, as indicated above, can be more expensive and more difficult to process.

The above and other advantages of the invention are more fully shown and described in the drawings and detailed description of this invention, where like reference numerals are used to represent similar parts. It is to be understood, however, that the drawings and description are for the purposes of illustration only and should not be read in a manner that would unduly limit the scope of this invention.

DETAILED DESCRIPTION OF THE PREFERRED EMBODIMENTS

In describing preferred embodiments of the invention, specific terminology is used for the sake of clarity. The invention, however, is not intended to be limited to the specific terms so selected, and it is to be understood that each term so selected includes all technical equivalents that operate similarly.

Figure 1:
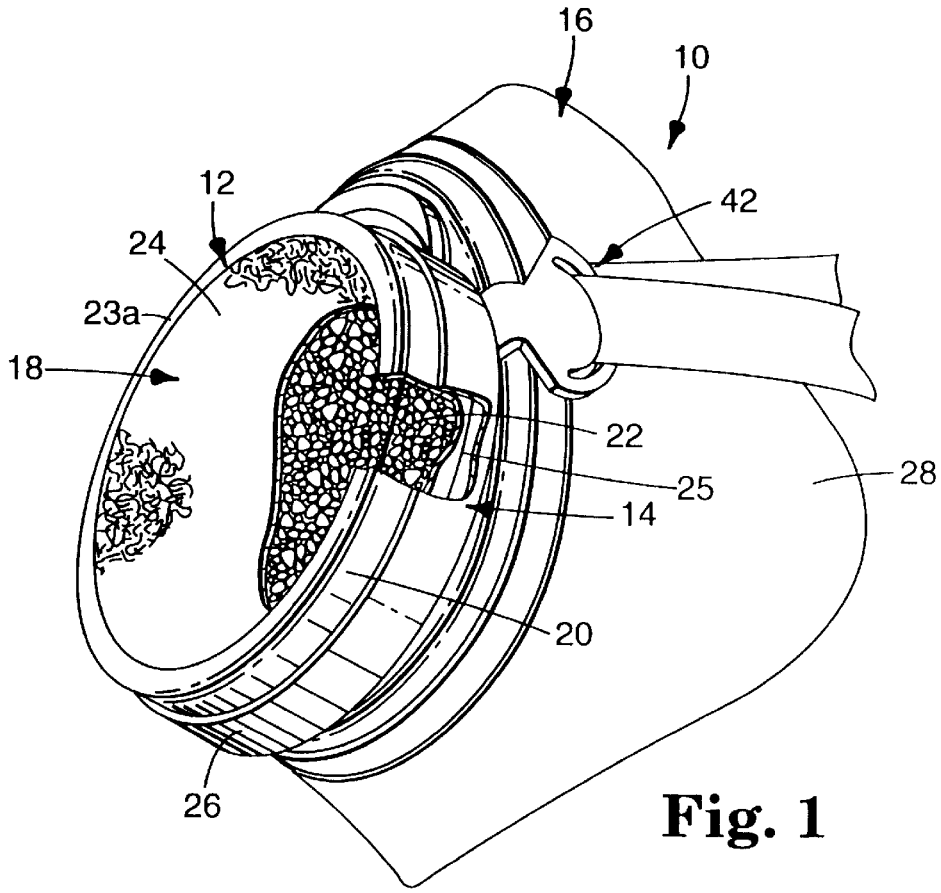
FIG. 1 is a partially-broken isometric view of a respirator 10 in accordance with the present invention.

Referring to FIG. 1, a respirator 10 is shown which includes a compressible filter element 12, a filter element retainer 14, and a face piece 16. Compressible filter element 12 includes a fluid permeable structure 18 capable of removing gaseous and/or particulate contaminants from a gaseous fluid such as air. A peripheral member 20 surrounds the peripheral surface 22 of the fluid permeable structure 18 and preferably includes overhanging flange 23*a*. Overhanging flange 23*a* is desired to prevent the breakthrough of contaminants at the interface of the peripheral member 20 and peripheral surface 22. Peripheral surface 22 extends between first (inflow) and second (outflow) faces 24 and 25, respectively. Filter element 12 is held in filter element retainer 14 by having peripheral member 20 frictionally engage wall 26 of retainer 14. The frictional engagement provides a hermetic seal at the interface of peripheral member 20 and wall 26.

Filter element 12 can be manually placed in retainer 14 by simply inserting the element 12 into the opening defined by wall 26 and pressing the filter element towards the back of the retainer 14. The frictional engagement also allows filter element 12 to be easily removed from retainer 14 by a manual force as described below. The frictional engagement is provided in part by the compressible filter element 12. Filter element 12, and particularly filter element retainer 14, are constructed of materials that enable the filter element 12 to compress when inserted into retainer 14.

Before being inserted into retainer 14, the filter element 12, as defined by the peripheral member 20, circumscribes a cross-sectional area slightly larger than the cross-sectional area defined by the interior of a wall 26. That is, the outer diameter of filter element 12 is greater than the inner diameter of wall 26. Thus, in reference to the filter element of this invention, the term "compressible" means the cross-sectional area of the filter element (normal to the direction of fluid flow) is reduced more than the retainer's cross-sectional area (defined by the interior side of the wall of the filter element retainer) is expanded when the filter element is inserted therein. In other words, the wall 26 is more rigid than the filter element; thus, when the filter element 12 is placed in the retainer 14, the filter element 12 compresses more than the retainer 14 expands, and the wall of the retainer exerts a compressive stress upon the filter element.

Generally, the non-compressed filter element (before being inserted into the retainer) has a cross-sectional area normal to fluid flow which is within the range of 10 to 200 square centimeters ($cm^2$), more preferably 30 to 80 $cm^2$. The area circumscribed by the wall of the retainer preferably is less than the area circumscribed by the peripheral member 20 but is not more than about 10 percent less than the cross-sectional area of the non-compressed filter element, more preferably is not more than 5 percent less, and still more preferably not more than 2 percent less, than the cross-sectional area of the non-compressed filter element. In a preferred embodiment, the filter element compresses to absorb at least 75 percent of the interference between the filter element and the retainer, and in a more preferred embodiment, compresses to absorb at least 90 percent of the interference between the filter element and the retainer. The "interference" is defined as the cross-sectional area of the non-compressed filter element normal to the direction of fluid flow which exceeds the cross-sectional area encompassed by the interior of the wall of the filter element retainer.

A preferred filter element 12 has a peripheral shape that lacks any inside curves; that is, there are no inflection points along the peripheral surface. A more preferred filter element has a circular peripheral surface such as shown in the drawings so that the radially compressive forces are uniformly distributed along the peripheral surface of the filter element. The filter element generally is cylindrical in shape but also may possess a tapered peripheral surface which engages a flat or correspondingly-tapered wall of a retainer.

Figure 2:
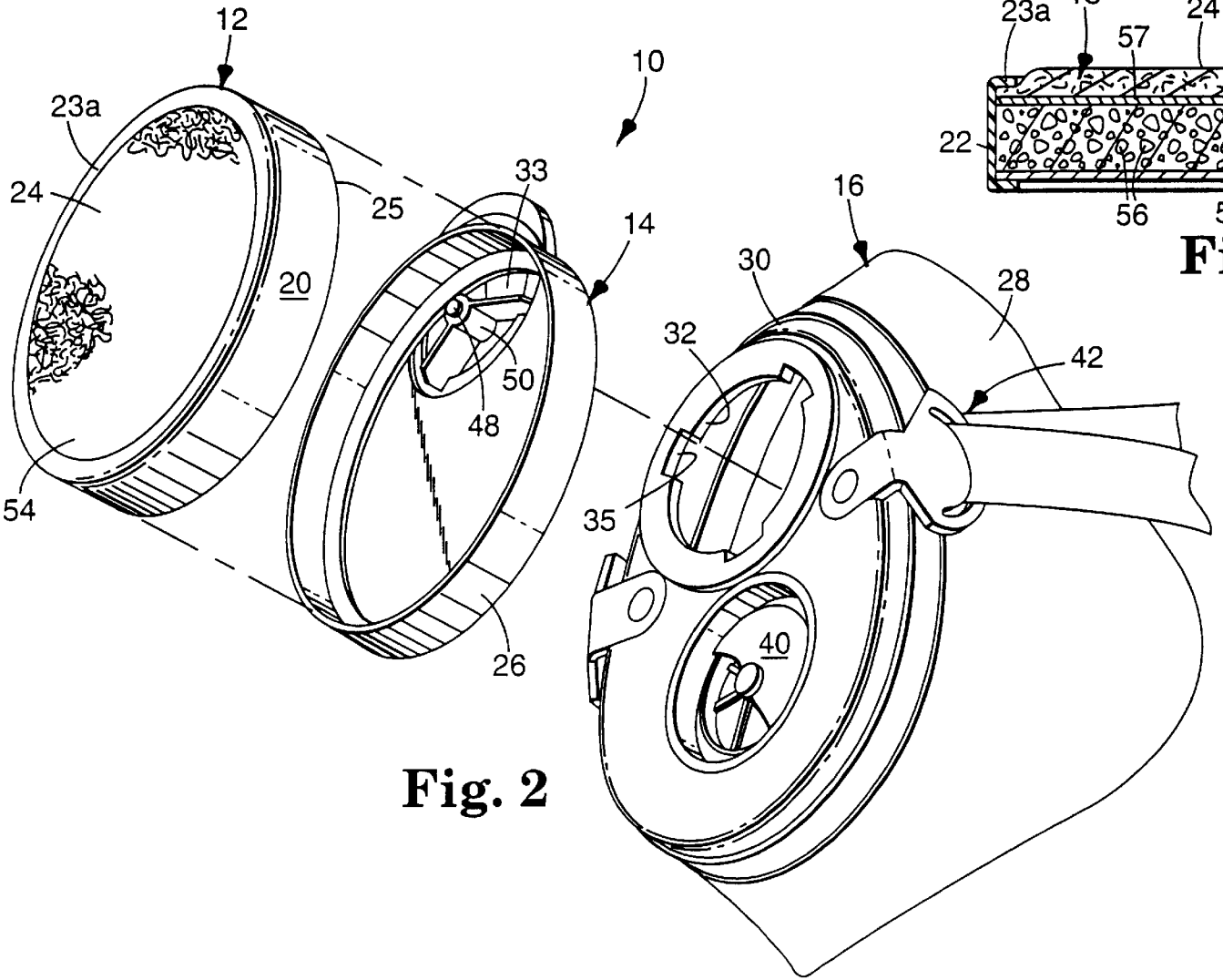
FIG. 2 is an expanded isometric view of a respirator 10 in accordance with the present invention.
Figure 3:
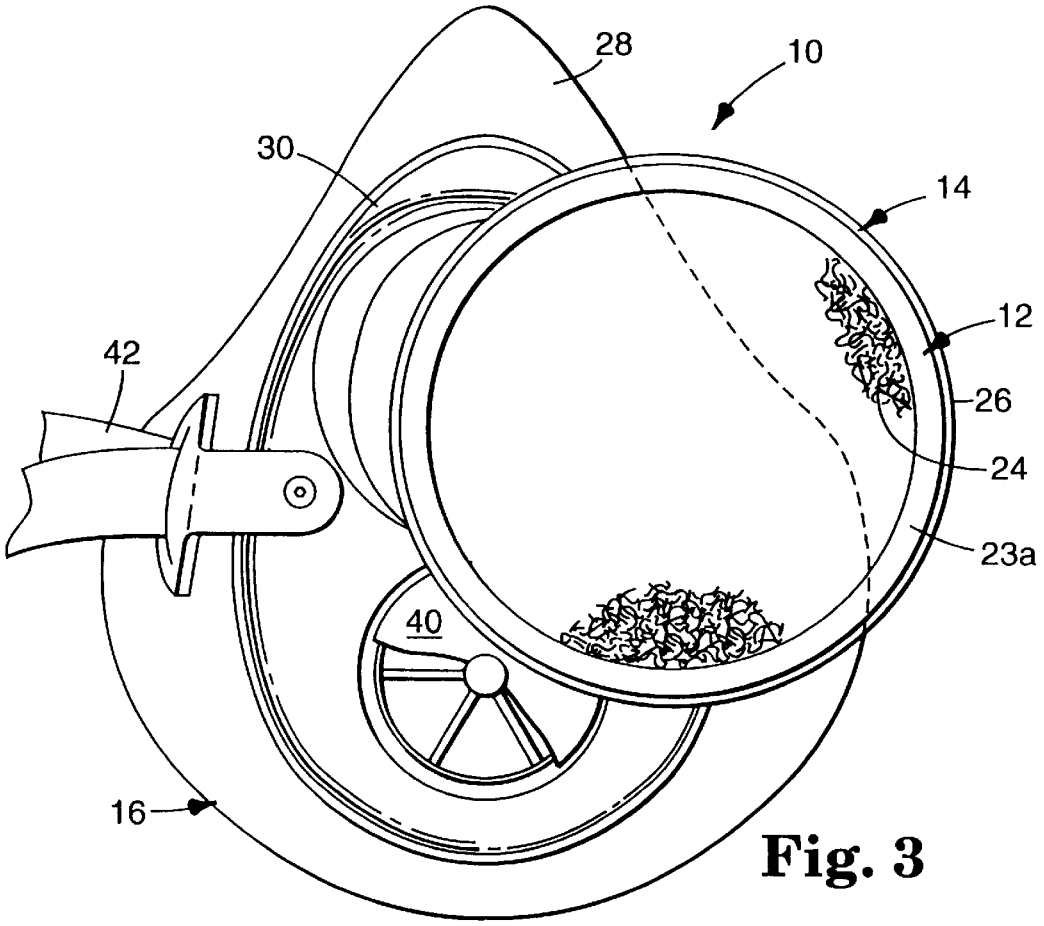
FIG. 3 is a front elevational view of a respirator 10 in accordance with the present invention, showing the filter element retainer 14 offset from its in use position.
Figure 4:
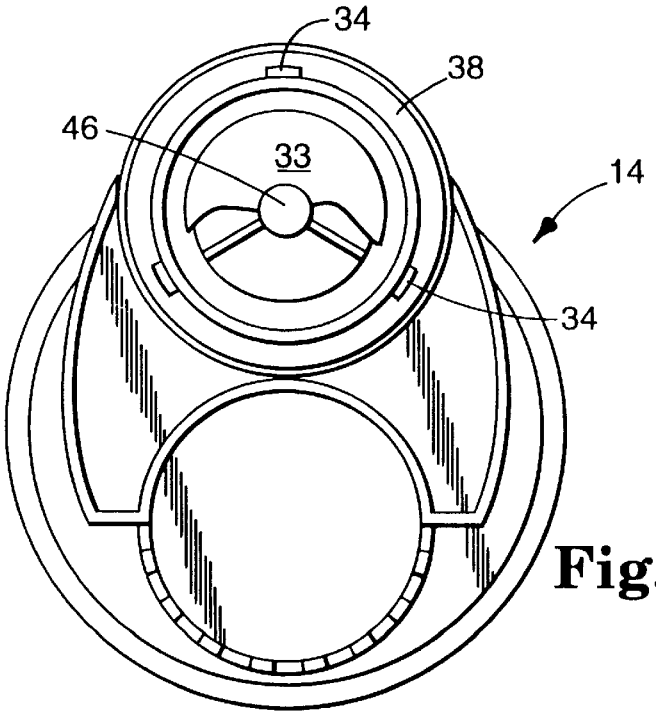
FIG. 4 is a back view of a filter element retainer 14 in accordance with the present invention.

Referring to FIGS. 2–4, it is shown in detail how respirator 10 may be constructed. As shown, the filter element retainer 14 can be detachably secured to face piece 16. Face piece 16 can comprise a soft compliant face-fitting portion 28 and a rigid structural portion 30. Such a face piece can be made, for example, as disclosed in U.S. Pat. No. 5,062,421 to Burns and Reischel. Soft compliant face-fitting portion 28 has a shape that is adapted to fit snugly over the nose and mouth of a wearer and can be made from a polymer such as styrene-ethylene/butylene-styrene block copolymer such as KRATON G 2705, Shell Oil Company. Rigid structural portion 30 can be made from a rigid plastic such as a polypropylene resin, for example, Pro-Fax™ 6523, Himont USA, Wilmington, Del. Rigid structural portion 30 includes an opening 32 for receiving filter element retainer 14. The filter element retainer 14 can be provided with a plurality of locking tabs 34 (FIG. 4) that engage opening 32 in face piece 16. To attach the retainer 14 to the respirator face piece 16, the locking tabs 34 are inserted into their corresponding spaces 35 in opening 32. The retainer 14 is then rotated from the position shown in FIG. 3 to the position shown in FIG. 1. A gasket 38 such as a silicone sponge 0-1038 (Lauren Co., New Philadelphia, Ohio) can be provided to insure that there is an air-tight fit between filter element retainer 14 and face piece 16. Air inhaled by the wearer passes through opening 32 and inhalation valve 33 after being filtered through filter element 12. Exhaled air passes through exhalation valve 40. A harness 42 can be attached to the face piece to fasten the mask to a wearer's head. The harness 42 can be a drop-down harness such as disclosed in U.S. patent application Ser. No. 08/121,697 entitled *Respirator Having A Drop-Down Harness* filed by David C. Byram on Sep. 15, 1993.

Figure 5A:
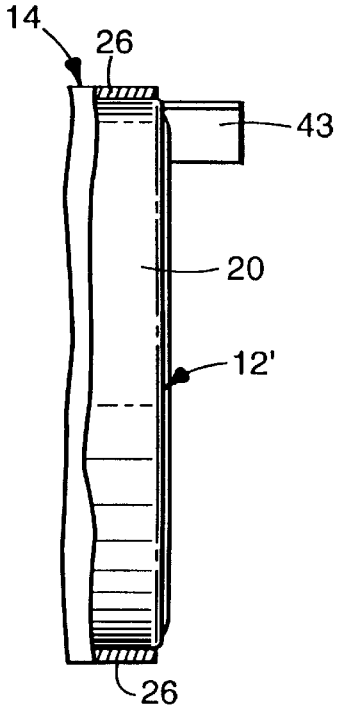
FIGS. 5A and 5B are partially-broken side views of filter elements 12', 12" in a filter element retainer 14 in accordance with the present invention.
Figure 5B:
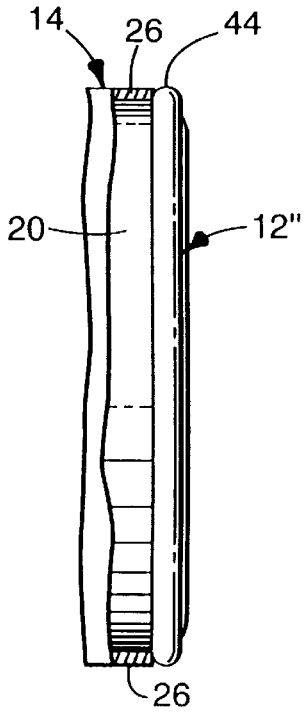

Filter element 12 can be manually removed from retainer 14 by various methods. What is meant by "manually" or "manual force" is that the filter element can be readily removed from the filter element retainer by use of a person's hands without assistance from any mechanical source separate from the respirator. There is no need for any external tool or instrument or any need to destroy or dismember the respirator to remove the filter element from the retainer. The force typically is applied exclusively to the filter element, and generally, is within the range of about 5 to 100 Newtons (N), and preferably within the range of about 15 to 50 N. In one embodiment shown in FIG. 1, the filter element 12 may protrude from the retainer 14 so that the former can be grasped about the peripheral surface 22 and pulled from the retainer 14. In another embodiment shown in FIG. 5A, a tab 43 may be provided on the filter element 12' to make the latter easier to grasp. Tab 43 can be particularly beneficial when the filter element 12' does not protrude from retainer 14. By grasping the tab 43 and pulling thereon with a force sufficient to overcome the frictional force between the peripheral member 20 and wall 26, the filter element 12 can be withdrawn from the retainer 14. In lieu of a tab 43, a lip 44 shown in FIG. 5B can be provided on the filter element 12 to facilitate manual removal of the filter element 12 from the retainer 14. Lip 44 can be formed when molding the filter element 12. In a further embodiment shown in FIGS. 2–4, a button 46 (FIG. 4) may be used to force the filter element 12 from the retainer 14. Button 46 can include a pin 48 (FIG. 2) which is slidably disposed in a sleeve 50 (FIG. 2). By manually pressing the button 46, a force may be exerted on the back surface 25 of filter element 12, causing the filter element 12 to be released from retainer 14.

Figure 6:
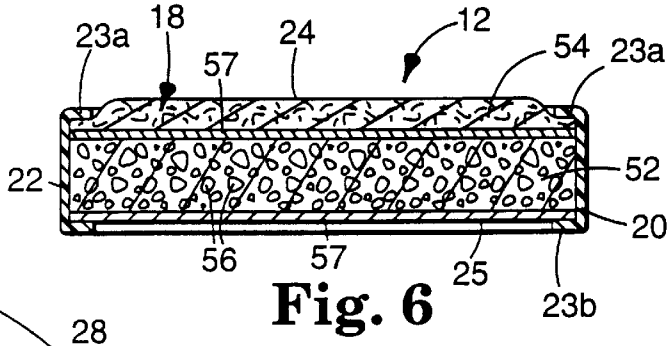
FIG. 6 is a cross-sectional view of a filter element 12 in accordance with the present invention.

Referring to FIG. 6, a cross-section of a compressible filter element 12 is shown which includes a sorbent filter 52 for removing gaseous contaminants and a fibrous filter 54 for removing particulate contaminants.

Sorbent filter 52 includes sorbent granules 56 united together in the form of a compressible porous body as taught, for example, in U.S. Pat. Nos. 5,033,465 and 5,078,132 to Braun and Rekow, the disclosures of which is incorporated here by reference. Such a bonded sorbent structure includes sorbent granules bonded together by polymeric binder particles to form the unified body. The sorbent granules are uniformly distributed throughout the unified body and are spaced to permit a fluid to flow therethrough. The sorbent granules can be, for example, activated carbon granules, alumina, silica gel, bentonite, diatomaceous earth, ion exchange resins, powdered zeolites (both natural and synthetic), molecular sieves, and catalytic particles, and the polymeric binder particles can be, for example, polyurethane, ethylene-vinyl acetate, and polyethylene. Other bonded sorbent structures, which may be useful in the present invention, are disclosed in the following U.S. Pat. Nos.: 3,091,550; 3,217,715, 3,353,544, 3,354,886, 3,375,933, 3,474,600, 3,538,020, 3,544,507, 3,645,072, 3,721,072, 3,919,369, and 4,061,807. The disclosures of these patents are incorporated here by reference. A scrim 57 may be placed on the inflow 24 and outflow 25 faces of sorbent filter 52 to assist in retaining any loose, unbonded granules.

The fibrous filter 54 may be, for example, a nonwoven web of electrically-charged microfibers, preferably melt-blown microfibers or a nonwoven web of electrically-charged fibrillated fibers. Fibrous filters that comprise electrically-charged melt-blown microfibers are well known in the art as evidenced by U.S. Pat. No. 4,215,682 to Kubik et al. and U.S. Pat. No. 4,592,815 to Nakao, the disclosures of which are incorporated here by reference. Fibrous filters that comprise electrically-charged fibrillated fibers are well known in the art as evidenced by U.S. Pat. No. RE 32,171 to Van Turnout, the disclosure of which is incorporated here by reference. The fibrous filter also may contain sorbent or chemically-active particles such as disclosed in U.S. Pat. No. 3,971,373 to Braun.

The sorbent and fibrous filters 52 and 54 are disposed in a peripheral member 20 that extends about the peripheral surface 22 of filter element 12. Peripheral member includes overhanging flange portions 23*a* and 23*b* to inhibit the breakthrough of contaminants at the peripheral surface 22 of bonded sorbent structure 52. The overhanging flange portions 23*a* and 23*b* preferably extended radially-inward from the peripheral surface 22 about 1 to 20 millimeters (mm), more preferably 2 to 8 mm. The peripheral member 20 can be made from essentially any material that allows the filter element to compress when frictionally engaged with the filter element retainer. The peripheral member 20 can be made from a polymeric material that is fluid impermeable and that can maintain a firm, intimate contact with the peripheral surface 22 of bonded sorbent structure 52. The polymeric material can be a polymeric film such as a heat-shrink film.

Heat-shrink films can be advantageous because they do not need an adhesive or other means to intimately secure the film to the peripheral surface of the bonded sorbent structure 18. Further, heat-shrink films allow overhanging flange portions 23*a*, 23*b* (FIG. 6) to be tightly formed over the circumference of the inflow and outflow surfaces 24 and 25. A firm intimate fit preferably is provided about the periphery of the inflow and outflow surfaces 24 and 25 and the peripheral surface 22. Examples of heat-shrink polymeric films that may be employed in this invention include: polyolefin heat-shrink tubing FP-301 available from 3M, St. Paul, Minn.; and Paklon™ heat-shrink tape also available from 3M. Other heat shrink films are disclosed in C. Benning, *Plastic Films for Packaging: Technology, Applications and Process Economics*, Technomic Publ. Co. (1983); and K. Osborn and W. Jenkins, *Plastic Films: Technology and Packaging Applications*, Technomic Publ. Co. (1992).

In lieu of a heat-shrink film, the peripheral member 20 may be injection molded, vacuum formed from a sheet of plastic, or it may be an adhesive tape. An injection molded peripheral member is preferred because it can be molded more precisely and with more detail than a vacuum-formed peripheral member, and it can form a better fit to the inflow and outflow surfaces than adhesive tape when an overhanging flange is provided. Vacuum forming, however, typically uses less expensive tooling and processing equipment than injection molding—so it may be favored for concept trials and initial feasibility work.

Features and advantages of this invention are further illustrated in the following examples. It is to be expressly understood, however, that while the examples serve this purpose, the particular ingredients and amounts used as well as other conditions and details are not to be construed in a manner that would unduly limit the scope of this invention.

EXAMPLES

Test Procedure

Filter elements were tested for service life by press fitting the filter element into a molded plastic filter element retainer containing a plenum and a means for directing the air flow into a Miran 103 infrared beam gas analyzer (Foxboro Company, South Norwalk, Conn.). The plastic filter element retainer used in the following examples was a polypropylene injection molded part with an inner diameter (ID) of 3.070 inches (78 mm), a filter depth of 0.36 inches (9.1 mm) and a plenum depth of 0.13 inch (3.3 mm). There was a 1.4 inch (36 mm) diameter center hole in the plastic filter element retainer that was connected in an air tight manner to a tapered glass fitting. The tapered glass fitting allowed the filter element retainer to be attached to test chambers used for testing for service life and particle penetration. To test the quality of the seal, filters press fit into the plastic filter holder were tested against an airflow of 30 liters per minute (1 pm), containing 50 percent relative humidity air and 300 parts per million (ppm) $CC1_4$. An air stream of such conditions is typical for testing industrial half mask respirators and in particular is representative of the conditions required by the Ministry of Labor in Japan (Standards for Gas Mask, Notice number 68 of Ministry of Labor, (1990)). As the filter was being challenged with 300 ppm $CC1_4$ in air, the effluent of the filter was monitored by a Miran 103 gas analyzer for breakthrough of $CC1_4$. The time between time zero and the time it takes for the effluent to reach 5 ppm of $CC1_4$ is referred to as the service life of the cartridge. A minimum service life of 50 minutes is required by the Japanese Ministry of Labor.

Filter elements were treated for penetration of particulates by attaching the filter elements to the filter holder as described above and challenging the filter element with a 95 1pm flow of NaCl particles at a concentration of 12 milligrams per cubic meter. The effluent of the filter was monitored with a TSI Model 8110 automatic filter tester available from Thermal Systems Inc., Saint Paul, Minn. The Model 8110 generates the NaCl particulate challenge and then measures and computes the percent penetration of the NaCl aerosol.

Example 1

Kuraray GG activated carbon with US Standard mesh size of 12×20 (1.68 mm×0.84 mm) was mixed in a thermal process with a thermoplastic polyurethane resin, Morthane™ PS455-100 (Morton Thiokol Company), the latter of which was reduced to powder form by grinding the polymer and then collecting the portion that would pass through a US standard 50 mesh screen (297 micrometers ($\mu$m). The range in size of the resulting polymer powder was approximately 37–297 $\mu$m with a mean particle diameter (MPD) of approximately 150 $\mu$m.

The carbon granules comprised about 88 percent or 24.6 grams (g) by weight of the resulting mixture. A 3.01 inch (76.5 mm) diameter spun bonded polyester scrim (Reemay number 2250, Reemay Company, Old Hickory, Tenn.) was placed in the bottom of a 3.04 inch (77.2 mm) diameter aluminum mold, and 28 grams of the above mixture was added to the mold in such a way that the mix was uniformly packed. Once the mixture was in the mold and leveled, another polyester scrim was placed on top of the mixture in the mold, and the material was heated to the melting point of the polymer binder particles. After 10 seconds, the molten bonded sorbent was transferred to a mold of similar dimensions, where it was compressed into a disc-shaped bonded sorbent. This produced a cylindrical bonded sorbent with a nominal thickness of 0.5 inches (12.7 mm) and a diameter of 3.03 inches (77.0 mm).

A polyolefin heat shrinkable tubing, FP-301 available from 3M, St. Paul, Minn. with a nominal diameter of 3 inches (76.2 mm) was cut into 1 inch (25.4 mm) width, and this cut band was then placed about the peripheral surface of the cylindrically shaped bonded sorbent structure in such a way that the tube extended equally beyond both filter surfaces in the axial dimension by approximately one-quarter inch (6.4 mm). The bonded sorbent with the FP-301 tubing around its peripheral surface was then placed in an oven at 165° C. for one and a half minutes to shrink the tubing to the peripheral surface. The resulting filter element had the heat shrunk film secured in intimate contact to the peripheral surface. An over hanging flange extending radially inward of approximately one-eighth inch (3.2 mm) was formed over the inflow and outflow faces of the filter element.

To demonstrate that the bonded filter elements of this invention provide a hermetic seal, the filter elements were tested against $CC1_4$ according to the test procedure set forth above. Table 1 shows service life data for three test samples.

TABLE 1

| Test Sample | Service Life (Minutes) |
|---|---|
| 1 | 136 |
| 2 | 126 |
| 3 | 138 |

The data in Table 1 demonstrate that the filter elements of this invention provide a service life that extends far beyond the 50 minute service life required for the test. The good service life is indicative of a hermetic seal to the filter retainer, as a poor service life would have meant that breakthrough or channeling of the contaminant through the filter element had occurred.

Example 2

This Example is provided to show that filter elements of the invention, which contain a fibrous filter and a sorbent filter, can contemporaneously demonstrate low particle penetration and good service life.

The gaseous filter was a bonded sorbent structure made according to the technique described in Example 1. The particulate filter was made by cutting a 3.015 inch (76.6 mm) diameter piece of 3M brand Filtrete™ filter media with a basis weight of 200 g/m$^2$. The cut pieces of filter media were then welded about their perimeter with an ultrasonic welding machine to produce a filter with a densified or welded perimeter annulus having OD of 3.015 inches (76.6 mm) and ID of 2.58 inches (65.5 mm). The FP-301 tubing was placed about the perimeter of the bonded sorbent structure as described in Example 1, and the Filtrete™ fibrous filter was placed on top of one of the surfaces of the bonded sorbent. The fibrous filter was positioned on the bonded sorbent such that, upon shrinkage of the polyolefin heat-shrinkable, FP-301 tubing described above, the overhanging flanges would grasp the welded edges of the fibrous filter, securing the fibrous filter to the bonded sorbent structure at the peripheral surface as shown in FIG. 6. Three samples were tested against a NaCl particulate challenge and a $CC1_4$ gas challenge for particulate penetration and service life, respectively. Data is reported in Tables 2a and 2b.

TABLE 2a

| Test Sample | Percent Penetration |
|---|---|
| 1 | 3.8 |
| 2 | 3.3 |
| 3 | 4.6 |

TABLE 2b

| Test Sample | Service Life (Minutes) |
|---|---|
| 1 | 125 |
| 2 | 130 |
| 3 | 139 |

The data in Tables 2a and 2b demonstrate that a filter element of the invention can be made in a relatively simple manner and that low particulate penetration values and satisfactory service lives can be obtained. The low particle penetration values and good service life data are indicative of an adequate hermetic seal between the filter element and the retainer.

Example 3

This Example illustrates another embodiment of a filter element of the present invention.

In lieu of FP-301 heat-shrink tubing of Example 1, a one inch (25.4 mm) wide, 0.002 inch (0.05 mm) thick, black Paklon™ beat shrinkable tape was employed. Paklon™ heat shrinkable tape includes a polyvinyl chloride (PVC) film having an adhesive backing. The bonded sorbent structures were made as described in Example 1, except the OD of the filter was 3.085 inches (78.4 mm) rather than 3.03 inches (77 mm). After the bonded sorbent structures were made, a 12 inch (304 mm) strip of the Paklon™ adhesive tape was measured and cut. The tape was applied about the peripheral surface of the bonded sorbent structure such that the tape extended beyond the inflow and outflow surfaces of the bonded structure approximately one-quarter inch (6.4 mm) and overlapped itself annularly by about 3 inches (76.2 mm). The purpose of the overlap was to ensure that the film when shrunk fully contacted the peripheral surface of the bonded sorbent structure and did not unravel. Cartridges made with the adhesive shrink tape were tested for service life. The results of the service life tests for three samples are reported below in Table 3.

TABLE 3

| Test Sample | Service Life (Minutes) |
|---|---|
| 1 | 119 |
| 2 | 123 |
| 3 | 127 |

The data In Table 3 demonstrate that filter elements of invention provide service lives well beyond the 50 minutes required by the Japanese Ministry of Labor. Furthermore, the good service life data are indicative of an adequate hermetic seal between the filter element and the retainer.

Example 4

The purpose of this Example is to demonstrate that polymeric materials other than heat shrink tubing can be secured to the peripheral surface of a bonded filter element to provide a secure press fit that does not leak.

Filter elements were made according to Example 3, except 3M Scotch™ 33+ tape was used instead of Paklon™ shrinkable film. Scotch™ 33+ is a 0.75 inch (19.1 mm) wide vinyl adhesive tape that does not shrink but can be intimately secured to the peripheral surface of a bonded sorbent structure. In securing the tape to the peripheral surface, the tape was slightly stretched and was pressed to the peripheral surface to form an adhesive bond thereto. An overhanging flange (1.6 mm) was provided by adhering equal portions of the excess tape width to the inflow and outflow faces of the bonded sorbent structure. Two filter elements were made and were tested for service life, the results of which are set forth below in Table 4.

TABLE 4

| Test Sample | Service Life (Minutes) |
|---|---|
| 1 | 147 |
| 2 | 142 |

The data in Table 4 demonstrate that the filter elements of this invention provide a service life that extends far beyond the 50 minute service life required for the test. The good service life is indicative of a hermetic seal to the filter retainer, as a poor service life would have meant that breakthrough of the challenge aerosol had occurred.

Example 5

This Example illustrates the use of a vacuum-formed plastic peripheral member for a filter element of the present invention.

The first step in making a vacuum formed part is to fabricate the mold that the molten plastic film will be formed over. In this Example, the mold was an aluminum cylinder 28.5 mm high and 78 mm in diameter at the top. At the bottom of the cylinder, the diameter was 78.7 mm. This slight enlargement of the cylinder diameter is commonly referred to as draft and is needed to assist in the removal of the part from the cylinder after the part has been formed and cooled. Vacuum holes were disposed at the edge of the aluminum cylinder to allow the vacuum to pull the film tightly over the cylinder. Four vacuum holes, 0.7 mm in diameter, were evenly spaced around the top perimeter of the cylinder. These holes were connected, via an air passage way, to the vacuum supply of the Model MBD-2121M vacuum forming machine (AAA Plastic Equipment Company Inc., Fort Worth, Tex.).

After making the mold, a 0.6 mm thick polypropylene film was cut to fit the vacuum forming machine and was placed on a carriage in the machine. The carriage was moved between heating elements where the film was heated until it was molten, after which time the carriage and film were returned to a position just above the cylindrical mold. Before the film was allowed to cool appreciably, the aluminum cylinder was pushed into the molten film simultaneous with the vacuum being engaged. This created a negative pressure at the vacuum holes in the cylinder. The negative pressure ensured that the film was pulled down uniformly and snugly over the cylinder.

The resulting cup-shaped plastic part was trimmed, pulled off of the cylinder, and a 67 mm diameter circle was then cut out of the center of the top. This created an annular ring or overhanging flange of plastic approximately 6 mm in width around the perimeter of the plastic part.

The wall of the plastic sleeve was 28.5 mm high and 0.4 mm thick. The thinning of the wall (0.7 mm to 0.4 mm) was a result of the stretching the film undergoes in the forming process. The next step was to assemble the filter element by inserting a bonded sorbent filter and a particle filter. The construction and dimensions of the bonded sorbent and particle filters are as described in Examples 1 and 2; however, there is an axial extension of the peripheral member of 6.4 mm above the bonded sorbent filter surface. The axial extension was then rolled over onto the surface of the bonded sorbent filter with an anvil heated to 185° C.

The filter elements were then press fit into the filter element retainer described in the Test Procedure section and tested for service life. The results of the service life tests are set forth in Table 5.

TABLE 5

| Test Sample | Service Life (Minutes) |
|---|---|
| 1 | 130 |
| 2 | 128 |
| 3 | 126 |

The data in Table 5 demonstrate that the filter elements of this invention provide a service life that extends far beyond the 50 minute service life required for the test. The good service life data is indicative of a hermetic seal to the filter retainer, as a poor service life would have meant that breakthrough of the challenge gas had occurred.

Example 6

This Example illustrates how a compressible particulate filter element lacking a bonding sorbent structure can be used in a filter cartridge of the invention. A commercially available Easi-Air 7255 particulate filter manufactured by 3M Company was modified by shrinking a 19 mm wide band of FP-301 heat shrink tubing around the peripheral surface to produce a filter element having a nominal OD of 78.2 mm. The Easi-Air 7255 is a light-weight filter element made up of pleated glass fibers and a pliable injection molded plastic frame which will compress when press fit into a filter element retainer. The filter element was press fit into the filter element retainer described previously and tested against a NaCl particle challenge. The penetration results for three test samples are shown below.

TABLE 6

| Test Samples | Percent Penetration |
|---|---|
| 1 | .001 |
| 2 | .001 |
| 3 | .001 |

The data in Table 6 demonstrate that a compressible particulate filter element of this invention provides a very low penetration. The low penetration values are indicative of an adequate hermetic seal between the filter element and the retainer.

Example 7

This Example shows how a filter element can be easily removed from a respirator of the invention.

To demonstrate the importance of having a compressible filter element, an experiment was performed using an Instron Model 4302 Materials Testing Machine. With the machine set up in the compression test mode, we were able to measure the force and energy required to remove filter elements of various constructions from the rigid retainer. Filter elements tested included those described in the previous Examples as well as an Easi-Air 7152, a commercially available gas and vapor cartridge manufactured by 3M Company. The Easi-Air 7152 cartridge is a rigid structure that includes a packed bed of activated carbon in a galvanized steel canister. The Easi-Air cartridge was modified by shrinking FP-301 around its edge in the same fashion as was described for the bonded sorbent filters. All the cartridges were press fit into the rigid filter element retainer previously described and were adapted to the machine so that a 25 mm diameter cylinder acting on the center of the cartridge would push it out of the holder. The cross-sectional areas of the filter elements and the retainers were measured before and after the filter elements were placed in the retainers. It was determined that the Easi-Air 7152 filter element was not compressible; that is, the retainer expanded more than the Easi-Air 7152 filter element compressed when the latter element was inserted into the former.

The crosshead speed of the Instron was 25 mm per minute. While the crosshead is advancing, it pushes the cartridge from the cartridge holder and logs the force detected by the load cell. The removal force was the maximum force detected by the machine, and the removal energy was the area under the stress strain curve. The results are reported below in Table 7.

TABLE 7

| Filter Element | Removal Force (Newtons) | Removal Energy (Joules × 1000) |
|---|---|---|
| Bonded Sorbent with FP-301 Shrink Tube | 37 | 90 |
| | 35 | 90 |
| | 35 | 79 |
| Easi-Air HEPA with FP-301 Shrink Tube | 19 | 57 |
| | 17 | 45 |
| | 24 | 79 |
| Bonded Sorbent with Polypropylene Sleeve | 30 | 107 |
| | 27 | 112 |
| | 27 | 112 |
| Easi-Air 7152 with FP-301 Shrink Tube* | 148 | 554 |
| | 148 | 542 |
| | 148 | 542 |

*Comparative Filter Element

The data in Table 7 demonstrate that both the removal force and the removal energy were substantially less when a compressible filter element was employed as compared to rigid or non-compressible filter element.

This invention may take on various modifications and alterations without departing from the spirit thereof. Accordingly, it is to be understood that this invention is not to be limited to the above-described but is to be controlled by the limitations set forth in claims and any equivalents of those limitations.

What is claimed is:

1. A respirator that comprises:

(a) a face piece sized to fit at least over the nose and mouth of a person;

(b) a compressible sorbent filter element that comprises sorbent granules united in the form of a compressible porous unified body and that has first and second faces separated by a peripheral surface; and (c) a filter element retainer connected to the face piece, the filter element retainer receiving the compressible sorbent filter element and including a wall that frictionally engages the peripheral surface of the filter element to compress the filter element to provide a hermetic seal thereto and to allow the filter element to be removed from the retainer by a manual force.

2. The respirator of claim 1, wherein the compressible filter element in a non-compressed condition has a cross-sectional area normal to fluid flow that is within the range of 10 to 200 $cm^2$.

3. The respirator of claim 2, wherein the filter element in a non-compressed condition has a cross-sectional area within the range of 30 to 80 $cm^2$.

4. The respirator of claim 3, wherein the area circumscribed by the wall of the retainer is not more than 5 percent less than the cross-sectional area of the non-compressed filter element.

5. The respirator of claim 2, wherein the wall of the filter element retainer circumscribes an area that is less than an area circumscribed by the wall of the non-compressed filter element but is not more than 10 percent less than the cross-sectional area of the non-compressed filter element.

6. The respirator of claim 5, wherein the area circumscribed by the wall of the retainer is not more than 2 percent less than the cross-sectional area of the non-compressed filter element.

7. The respirator of claim 1, wherein there is an interference between the compressible filter element and the wall of the retainer, and wherein the filter element when inserted into the retainer compresses to absorb at least 75 percent of interference between the filter element and the wall of the retainer.

8. The respirator of claim 7, wherein the filter element when inserted into the retainer compresses to absorb at least 90 percent of the interference between the filter element and the retainer.

9. The filter element of claim 1, wherein the filter element has a peripheral shape that lacks any inside curves.

10. The respirator of claim 9, wherein the filter element has a circular peripheral surface.

11. The respirator of claim 1, wherein the force needed to manually remove the filter element from the retainer is within the range of 5 to 100 Newtons.

12. The respirator of claim 11, wherein the force needed to manually remove the filter element from the retainer is within the range of 15 to 50 Newtons.

13. The respirator of claim 1, wherein the filter element protrudes from the retainer so that the filter element can be grasped with a person's hands about the peripheral surface.

14. The respirator of claim 13, wherein the filter element has a lip on the peripheral surface to facilitate grasping the filter element.

15. The respirator of claim 14, wherein the filter element includes a bonded sorbent structure that is molded to provide the lip on the peripheral surface.

16. The respirator of claim 1, wherein the filter element includes a tab for facilitating manual removal of the filter element from the filter element retainer.

17. The respirator of claim 1, wherein the filter element retainer includes a button for manually forcing the filter element from the retainer.

18. The respirator of claim 1, wherein the sorbent granules are uniformly distributed throughout the compressible porous unified body and are spaced to permit a fluid to flow therethrough, the sorbent granules being bonded together by polymeric binder particles.

19. The respirator of claim 1, wherein the compressible filter element includes a nonwoven web of fibers.

20. The respirator of claim 19, wherein the compressible filter element includes a peripheral member that extends about the peripheral surface of the filter element and that includes an overhanging flange portion that extends radially inward at from 2 to 8 millimeters.

21. The respirator of claim 1, wherein the compressible filter element includes a peripheral member that extends about the peripheral surface of the filter element.

22. The respirator of claim 21, wherein the peripheral member comprises a polymeric material that is fluid impermeable and that maintains a firm intimate contact with the peripheral surface of the compressible filter element.

23. The respirator of claim 22, wherein the peripheral member comprises a heat-shrink film.

24. The respirator of claim 22, wherein the peripheral member comprises an injectable molded plastic.

25. The respirator of claim 1, wherein the peripheral member includes an overhanging flange portion that extends radially inward from the peripheral surface at from 2 to 8 millimeters.

26. A method of replacing a respirator's filter element, which method comprises:

(a) manually removing a first compressible filter element from a filter element retainer of the respirator; and (b) manually inserting a second compressible filter element into the retainer, the second compressible filter element being compressed upon being inserted into the retainer and making an airtight fit thereto;

wherein the first and second compressible filter elements each include a sorbent filter that comprises sorbent granules that are united together in the form of a compressible porous unified body.

27. The method of claim 26, wherein the compressible filter element includes a peripheral member that extends about the peripheral surface of the filter element.

* * * * *

UNITED STATES PATENT AND TRADEMARK OFFICE

CERTIFICATE OF CORRECTION

PATENT NO. : 6,216,693 B1
DATED : April 17, 2001
INVENTOR(S) : Rekow et al.

It is certified that error appears in the above-identified patent and that said Letters Patent is hereby corrected as shown below:

Title page,
"FIR" should read as -- FIT --.

Colum 12,
Line 56, insert -- the -- between "in" and "claims".

Signed and Sealed this

Second Day of November, 2004

JON W. DUDAS
*Director of the United States Patent and Trademark Office*